US006637130B2

(12) United States Patent
Urie et al.

(10) Patent No.: US 6,637,130 B2
(45) Date of Patent: Oct. 28, 2003

(54) SANDAL STRAPPING SYSTEM

(75) Inventors: Grant A. Urie, Burlington, VT (US); Clark A. Matis, Charlotte, VT (US)

(73) Assignee: Wolverine World Wide, Inc., Rockford, MI (US)

( * ) Notice: Subject to any disclaimer, the term of this patent is extended or adjusted under 35 U.S.C. 154(b) by 83 days.

(21) Appl. No.: 10/045,136

(22) Filed: Oct. 23, 2001

(65) Prior Publication Data

US 2003/0074806 A1 Apr. 24, 2003

(51) Int. Cl.[7] ..... A43B 3/12
(52) U.S. Cl. ..... 36/11.5; 36/50.1
(58) Field of Search ..... 36/11.5, 50.1

(56) References Cited

U.S. PATENT DOCUMENTS 1,088,309 A * 2/1914 Weidt ..... 36/11.5
2,038,151 A * 4/1936 Wernmark ..... 36/11.5
2,112,884 A * 4/1938 Gillette et al. ..... 36/11.5
2,126,094 A * 8/1938 Daniels ..... 36/11.5
2,259,273 A * 10/1941 Smith ..... 36/11.5
2,468,573 A * 4/1949 Rimer ..... 36/11.5
6,021,585 A * 2/2000 Cole ..... 36/11.5

FOREIGN PATENT DOCUMENTS

GB 2147792 * 5/1985

OTHER PUBLICATIONS

Chaco Catalog, pp. 8–14.

* cited by examiner

*Primary Examiner*—Ted Kavanaugh
(74) *Attorney, Agent, or Firm*—Warner Norcross & Judd

(57) ABSTRACT

A sandal construction, including a sole and a strapping system for retaining the sole on a foot. The strapping system includes a front strap and a buckle strap that cooperatively adjust and retain the sandal on the foot of the wearer. The front strap extends from the ankle region to the forefoot region passing over and through the sole. The front strap crisscrosses to form an X-shaped crossover that is substantially centered in the forefoot region. The front strap extends through a buckle that is attached to an adjustable-length buckle strap. The wearer adjusts the strapping system through both the ankle and forefoot regions simply by adjusting the length of the buckle strap.

29 Claims, 5 Drawing Sheets

SANDAL STRAPPING SYSTEM

BACKGROUND OF THE INVENTION

I. Priority

This application claims priority from design patent application No. 29/142,904 filed Jun. 5, 2001, and entitled "Sandal Portions".

II. Field of the Invention

The present invention relates to footwear constructions, and more particularly to a sandal construction.

III. Description of the Art

Sandals have typically functioned as casual footwear, providing only limited support and stability. As a result, traditional sandals were not well suited for use in athletic and sporting applications. More recently, however, sandals have evolved to provide increased support and stability, making them more suitable for a variety of athletic and sporting applications. These improvements have resulted primarily from advances in the sole and in the strapping system. Although there has been marked growth in the comfort and support provided by sandals, footwear manufacturers continue to search for technologies capable of further enhancing the comfort and support of sandals.

Conventional sport sandals include a contoured sole and a strapping system for retaining the sole against the bottom of a foot. Typical sandals of this type include a front strap for retaining the forefoot, and ankle and heel straps for retaining the rear portion of the foot. The front strap extends over the forefoot of the foot and includes opposite ends which are generally affixed to the sole. The front strap is typically length-adjustable to permit the sandal to be adjusted to snuggly fit different size feet. The ankle strap extends over the top surface of the foot just in front of the ankle and includes opposite ends affixed to inner and out ankle posts or directly to the sole. The heel strap wraps around the rear heel portion of the foot and, like the ankle strap, is affixed to the ankle posts or directly to the sole. As with the front strap, at least one of the ankle or heel strap is typically adjustable in length to permit the sandal to be adjusted to snuggly fit different size feet. These conventional two-strap systems require two separate adjustments to properly secure the sandal on the wearer's foot. As a result, the front strap is often adjusted to provide a loose fit so that the forefoot can be easily slipped into and out of the sandal—leaving only the ankle or heel strap to be adjusted each time the sandal is worn. Although this makes it easier to put on the sandal, it can, unfortunately, reduce the foot support provided by the sandal and potentially lead to foot or ankle injury.

Some manufacturers have simplified the strap system by using a single adjustable strap that extends from the ankle region over the forefoot and then back to the ankle region. By adjusting this single strap, sandal is secured on the foot and the fit of the sandal in both the ankle and forefoot regions is controlled. A conventional sandal having a single adjustable strap is shown in FIG. 1. As illustrated, the sandal 150 includes a sole 152 and a strap 160. The strap 160 is attached to a medial post 170 at one end, is threaded through the sole 152 and over the foot, and is threaded through a buckle 172 that is attached to a lateral post 174. The strap 160 is positioned on the sole 152 to cross over itself in the front portion of the sandal, with the two crossed strap portions defining a forefoot strap. The strap 160 passes freely through the sole 152 so that pulling one end of the strap 160 results in tightening the entire strap, including in both the forefoot and ankle regions.

Although this strapping system keeps the sandal 150 attached to the foot, the strap 160 is configured to crosses over itself in the forefoot region near the lateral edge of the sandal. The laterally disposed crossover 171 may permit the foot to move within the sandal, possibly reducing support over the forefoot as a whole and causing discomfort. In addition to crossing over itself in the forefoot region, the strap 160 also crosses over itself just in front of the ankle at crossover 173 These two crossovers 171 and 173 create pressure points that may cause chafing and discomfort both while the strap 160 is being adjusted and during walking. This problem is only exacerbated as the strap is increasingly tightened. Further, because the strap 160 moves with respect to the sole 152, there is a potential for the strap 160 to rub against and cause significant wear of the sole 152. To address this concern, the sole 152 must manufactured from harder, more wear-resistant materials, such as polyurethane. Unfortunately, anti-bacterial components, such as Microban® available from Microban Products Company, cannot be added to polyurethane and other similar components. As a result, sandals manufactured from this material are subject to odor control issues. This is a particularly acute problem with sandals because they are often worn in wet and dirty environments, where bacteria can readily contaminate the sole. To address this concern, manufacturers typically recommend periodic washing of the sandal. This is inconvenient and burdensome, so much so that it is often not done.

Additionally, conventional sandals of this type are difficult to adjust when under load. Although the sole 152 is manufactured from a relatively hard material, it is, by design, sufficiently soft to provide some level of cushioning (e.g. some level of compression when under load). As a result, the sole 152 will compress under load, pinching those portions of the strap that pass through the sole 152. Significant loads can make it difficult, if not impossible, for the wearer to manually adjust the strap.

SUMMARY OF THE INVENTION

The aforementioned problem are overcome by the present invention wherein a sandal construction is provided with an adjustable strap that passes through the sole and over the foot forming a crossover at substantially the center of the forefoot.

In a preferred embodiment, the sandal includes a strapping system having medial and lateral posts positioned on opposite sides of the ankle. A heel strap extends between the posts around the heel. The strapping system also includes a front strap that extends between the ankle and forefoot regions of the sandal. The strap includes a first end that is secured to the sole in the forefoot region. The strap crisscrosses over substantially the center of the foot in the forefoot region and then extends rearwardly to an ankle post.

In a more preferred embodiment, the sole defines a plurality of channels passing between the lateral and medial sides of the sandal to permit passage of the front strap. The sole further defines spaced apertures near each edge of the sole to allow the front strap to pass into the channels from the upper side of the sandal.

In an even more preferred embodiment, the sole includes a flexplate disposed between a midsole and an outsole. The flexplate is substantially rigid providing support and stability to the sandal. The flexplate may also define the channels through which the front strap passes. Covers may be placed over the channels to entrap the strap in rigid tunnels.

The present invention provides a sandal having a continuous front strap that permits simultaneous adjustment in both the ankle and heel regions as the sandal is secured to the foot. The front strap is relatively easy to adjust and is positioned on the sole to provide improved comfort and support. The substantially centered crossover in the forefoot region provides improved comfort and lateral stability. Further, the flexplate reduces wear in the midsole by providing a hard surface for the strap to move against. This permits the midsole to be manufactured from softer materials, including various materials that can be impregnated with an anti-bacterial component to reduce bacterial growth. The flexplate also provides a low friction surface to ease movement of the strap during adjustment. Also, the flexplate channels facilitate manufacture by positively and easily locating the straps. The flexplate covers enclose the straps in rigid tunnels. This protects the straps from being pinched by the sole, and permits easy adjustment even under when the sandal is under load.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
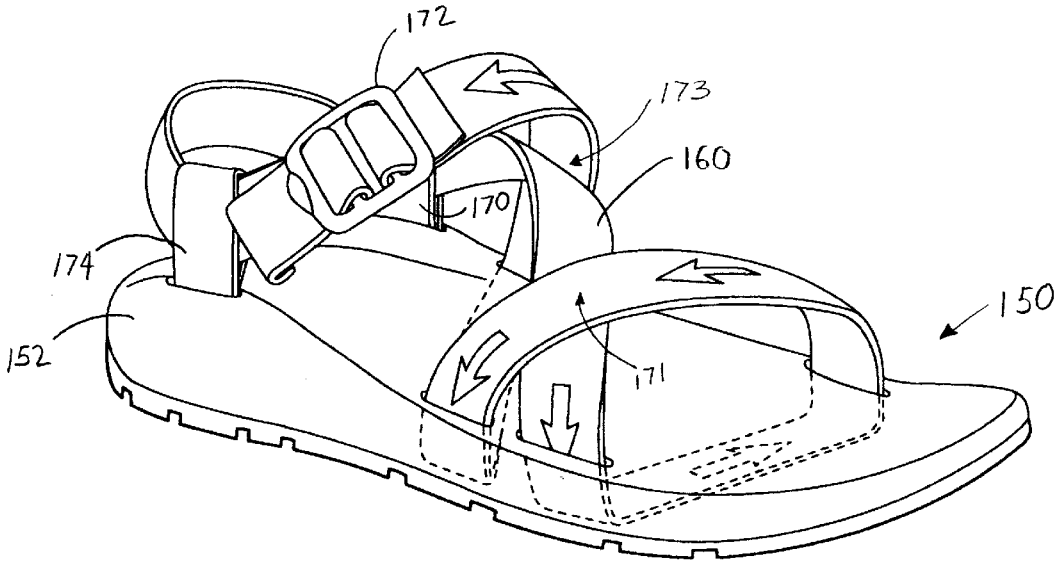
Fig. 1 (Prior Art)
FIG. 1 is a perspective view of a sandal according to the prior art.
Figure 2:
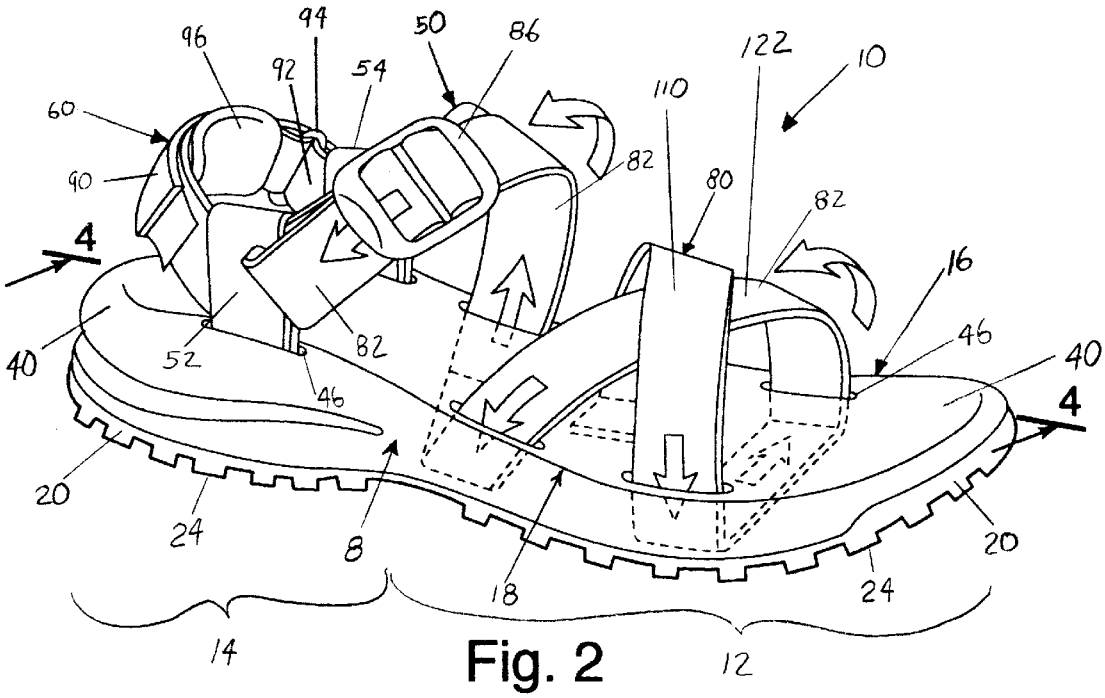
FIG. 2 is a perspective view of a sandal incorporating the present invention.
Figure 3:
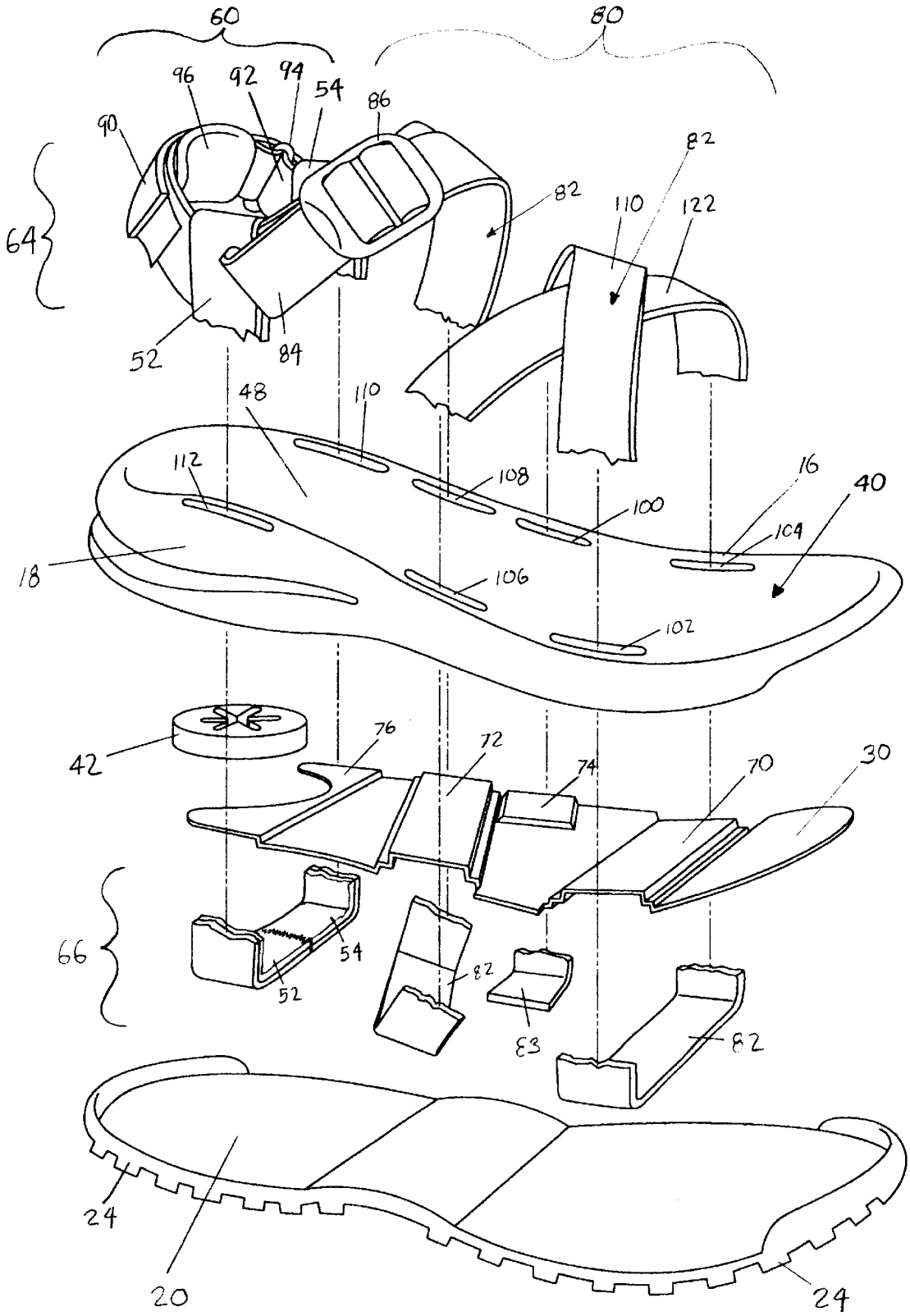
FIG. 3 is an exploded perspective view of the sandal.

A sandal constructed in accordance with a preferred embodiment of the present invention is shown in FIGS. 2 and 3 and generally designated 10. In general, the sandal 10 includes a sole 8 and a strapping system 50. The sole 8 includes an outsole 20, a flexplate 30 and a midsole 40. The strapping system 50 includes a continuous front strap 82 that runs from the ankle post through the sole 8 and crisscrosses in the forefoot region to retains a wearer's foot. The illustrated sandal 10 is intended to be worn on the right foot and will be described in detail. Of course, a sandal intended to be worn on the left foot may be a mirror image of the illustrated sandal 10.

The sandal 10 includes front and rear portions 12 and 14, and opposing edges 16 and 18. The opposing edges 16 and 18 are termed the inner or medial edge 16 and the outer or lateral edge 18. By way of further clarification, when worn, the medial edge 16 of the illustrated sandal 10 for the right foot will face the medial edge of the sandal for the left foot (not shown).

I. Construction

As noted above, the sandal 10 includes a sole 8 and a strapping system 50. The sole 8 generally includes an outsole 20, a flexplate 30 and a midsole 40 The outsole 20 engages the ground and forms the wear surface of the sandal 10. The outsole 20 is generally conventional and is made of conventional outsole materials that are selected to provide the desired balance between comfort, wear and traction. Although the outsole is preferably a conventional rubber compound, a variety of other materials may be used to provide the desired comfort, wear and traction. The outsole 20 may include tread 24, lugs (not shown) or otherwise be configured to enhance traction. The design and configuration of the outsole 20 will vary from application to application as desired.

Figure 6:
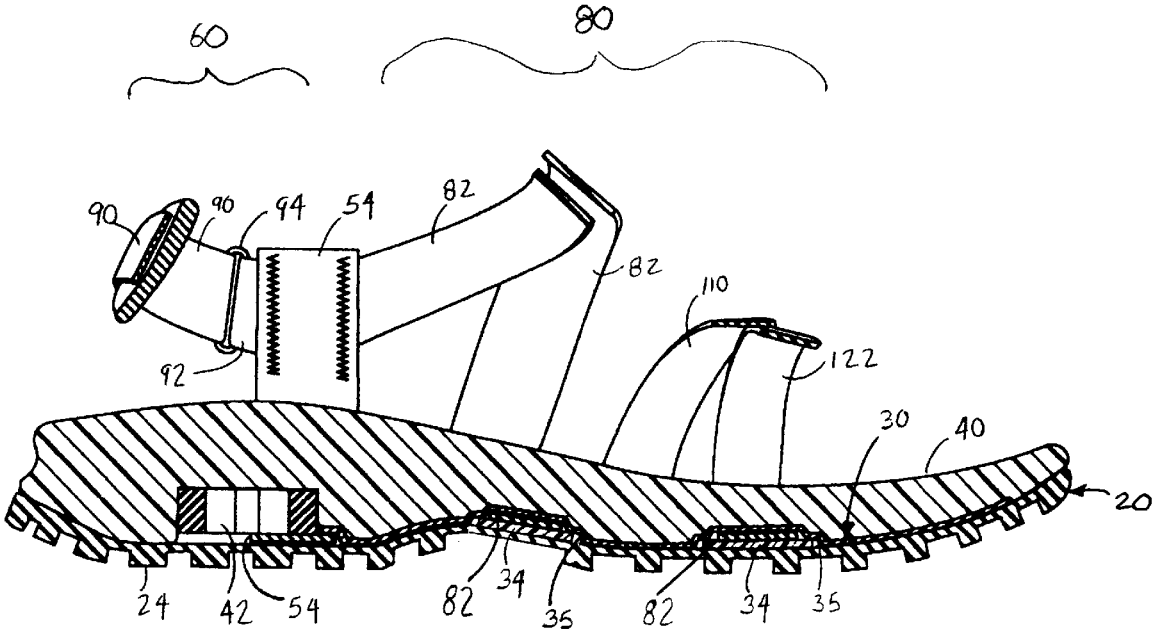
FIG. 6 is a sectional view along line 4—4 in FIG. 2 of a sandal incorporating the present invention with covers.
Figure 7:
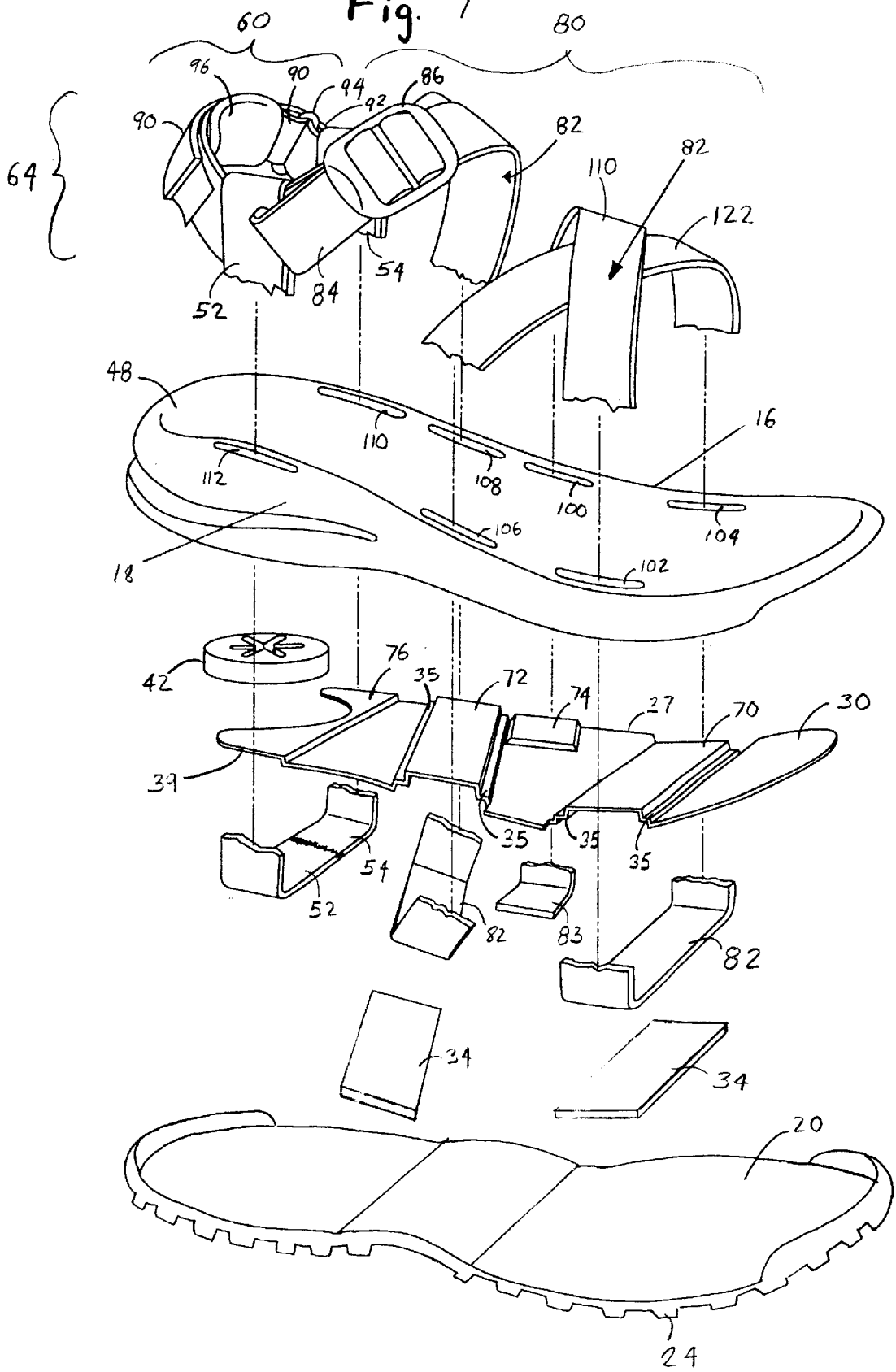
FIG. 7 is an exploded perspective view of the present invention with optional covers.

The flexplate 30 is a substantially rigid plate that extends along a majority of the sole 8 providing enhanced stability and support. In the preferred embodiment, the flexplate 30 is partially entrapped by the midsole 40. Alternatively, the flexplate 30 can be completely encased within the midsole 40 so that the outsole 20 engages only the midsole 40. The flexplate 30 is preferably contoured to follow the shape of the sole 8 and the shape of the wearer's foot. The flexplate 30 defines a plurality of channels 36 that, as described in more detail below, provide passages and locating means for portions of the strapping system 50. Portions of the strapping system 50 may slide through some of the channels 36 or may be stationary in other channels 36. The channels 36 are preferably defined by variations in the shape of the plate. As shown in FIGS. 6 and 7, covers 34 are preferably placed over the channels 36 to define tunnels that entrap the corresponding strap portions and prevent difficulty in adjusting the sandal 10 under load. In the preferred embodiment, the flexplate 30 defines a front channel 70 and a middle channel 72. The flexplate 30 also defines a pair of shoulders 35 extending along each side of the channels 70 and 72. The shoulders 35 are configured to receive the covers 34. The flexplate 30 also includes medial and lateral edges 37 and 39 that may be rounded or define indentations (not shown) to allow the strapping system 50, discussed below, to pass in and out of the channels 36 without binding or wearing against the edges 37 and 39 of the flexplate 30. As can be seen in FIGS. 6 and 7, the covers 34 work in conjunction with the flexplate 30 to form a continuous surface along the length of the flexplate 30 so that the outsole 20 may be firmly and securely attached. In the preferred embodiment, the front channel 70 is approximately perpendicular to the medial and lateral edges 37 and 39 of the flexplate 30. The middle channel 72 is angled somewhat from the perpendicular axis of the medial and lateral edges 37 and 39. Of course other angles may readily be used as desired while providing the strapping system 50.

The flexplate 30 also defines a channel segment 74 in which one end of the front strap 82 is attached as discussed below. In the preferred embodiment, the channel segment 74 is located near the middle channel 72 and connected to the medial edge 37 of the flexplate 30. Further, the flexplate 30 defines a rear channel 76 disposed at the rear of the sandal 10. The rear channel 76 receives the ankle post strap 56 as described below. Because the straps are fixed within channel segment 74 and rear channel 76 (e.g. they are not intended to move during adjustment of the straps), covers are not disposed over the rear channel 74. Accordingly, the channel segment 74 and the rear channel 76 are preferably not as deep as the front and middle channels 70 and 72 and do not include shoulders.

The flexplate 30 further includes a heel portion 32 that is shaped to accommodate an air-cushioning device 42. The flexplate 30 is manufactured from a rigid material selected to provide the sandal 10 with the desired rigidity. The air-cushioning device provides increased compression in the heel region. Air-cushioning devices 42 are well known in the art. As shown in FIG. 3, one such air-cushioning device 42 fits within the heel portion 32 of the flexplate 30. Of course, it should be readily apparent that the air-cushioning device 42 and the heel portion 32 may be of any shape or size. In the preferred embodiment, the air-cushioning device 42 is generally placed under the heel of the wearer and within the midsole 40 to provide extra cushioning while wearing the sandal 10. By forming the flexplate 30 somewhat around the air-cushioning device 42 in the area where the heel contacts the midsole, more cushioning may be provided for the wearer. In the preferred embodiment, the air-cushioning device 42 does not interfere with the stability and rigidity provided by the flexplate 30. In some cases where more stability and rigidity is desired, the flexplate 30 may run the entire length of the midsole 40 with the air-cushioning device 42 being eliminated or placed on top of the flexplate 30.

A suitable material for manufacturing the flexplate 30 is a polymeric amide such as nylon. The nylon may be reinforced with fiberglass or other materials. A conventional bonding material may also be applied to the flexplate 30 to improve the bond between the differing materials of the flexplate 30 and the midsole 40 or the outsole 20.

Figure 5:
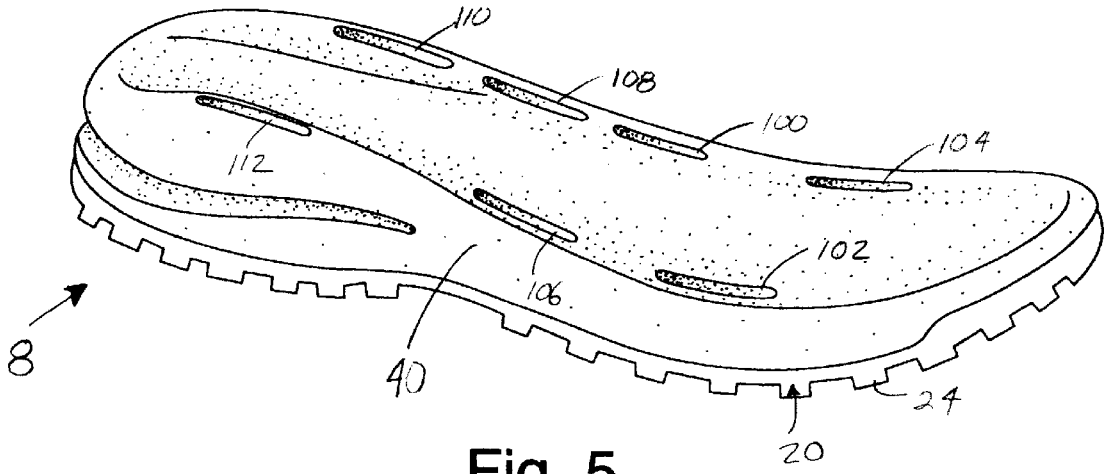
FIG. 5 is a perspective view of the sole of the sandal.

The midsole 40 is manufactured from relatively resilient material, selected to provide the sole 8 with the desired level of cushioning. The midsole overlays the outsole 20 and preferably entraps the flexplate 30. In the preferred embodiment, the midsole 40 is formed out of ethyl vinyl acetate (EVA). Using EVA to form the midsole 40, instead of polyurethane, allows the midsole 40 to include an anti-bacterial agent such as MicroBan®. Further, the midsole 40 is contoured for comfort as shown in FIG. 5, although it should be readily apparent that other contours and configurations may be used. Three-dimensional contouring provides more comfort for the wearer. The top surface 48 of the midsole 40 may also include texturing to improve comfort and helps locate the foot of the wearer on the sole 8. The midsole 40 defines apertures 46 through which the strapping system 50 passes. The apertures 46 allow the strapping system 50 to pass from the top side 48 into the channels 36. More specifically, apertures 100 and 102 are aligned with opposite ends of the front channel 70, apertures 106 and 108 are aligned with opposite ends of the middle channel 72, and apertures 110 and 112 are aligned with opposite ends of the rear channel 76. Further, aperture 100 is aligned with the open end of channel segment 74. The apertures 46 and the channels 36 generally work in conjunction to allow the strapping system 50 to pass under the midsole 40 and the flexplate 30 and exit the apertures 46 on the opposing side.

As noted above, the strapping system 50 functions to secure the wearer's foot to the sole 8. The strapping system 50 an ankle portion 60 and a forefoot portion 80, both of which are adjustable to match the fit of the sandal 10 to the wearer's foot.

The ankle portion 60 includes lateral and medial ankle posts 52 and 54 that extend upwardly from the lateral and medial sides 16 and 18, respectively, of the rear portion 14 of the sole 8. The ankle posts 52 and 54 are preferably defined by opposite ends of a single ankle strap 56. The ankle strap 56 extends through the rear channel 76 and protrudes from apertures 110 and 112. The ankle strap 56 may be secured in the rear channel 76 by adhesive. In the preferred embodiment, the ankle strap 56, and hence the ankle posts 52 and 54, is formed out of a nylon strap that is doubled over to provide a certain degree of rigidity, allowing the ankle post 52 and 54 to maintain a somewhat upright position from the sole 8 as shown in FIG. 3. The ankle posts 52 and 54 may also be formed by passing a single nylon strap through the rear channel 76 and doubling over just the upper portion 64 as shown in FIG. 7. The ankle posts 52 and 54 could be made of leather, canvas or a variety of other materials or combinations of materials. A variety of other configurations may also be used to form the ankle posts 52 and 54.

Figure 4:
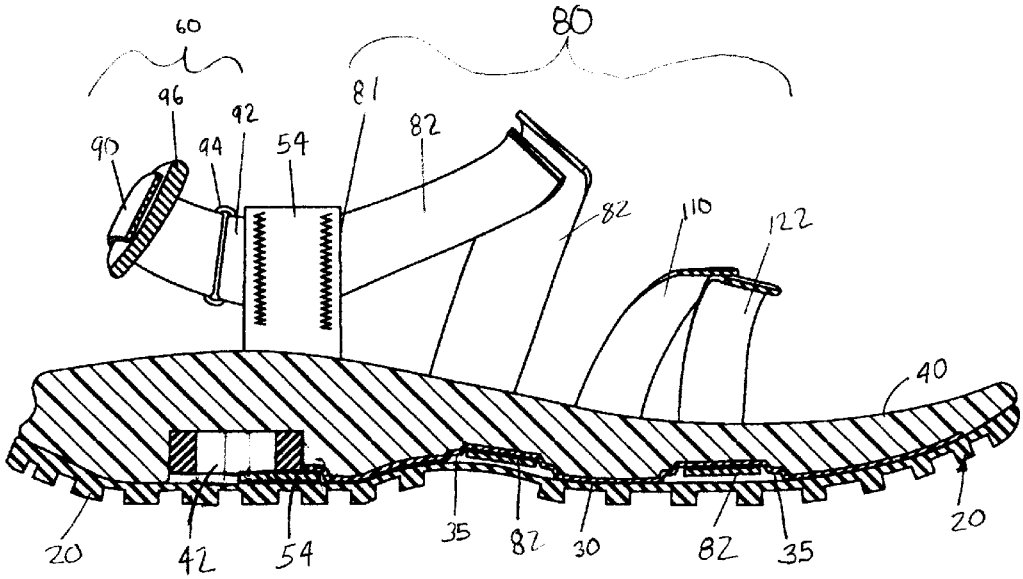
FIG. 4 is a sectional view along line 4—4 in FIG. 2 of a sandal incorporating the present invention without the optional covers.

The ankle portion 60 also includes a first strap 90, a second strap 92, an elliptical ring 94 and a cushioning layer 96. In the preferred embodiment, the first strap 90 is attached to the lateral ankle post 52 and the second strap 92 is attached to the medial ankle post 54. The second strap 92, as shown in FIGS. 3 and 4, forms a loop around the elliptical ring 94. The first strap 90 passes across the sandal 10 to the medial side 16, through the elliptical ring 94, and back across to the lateral side 18. The first strap 90 may include hook and loop fasteners, such as Velcro®, to adjustably secure the first strap 90 back onto itself. Other methods of closure may be used such as snaps, buckles, or a fixed non-adjustable strap. The first and second straps 90 and 92 are preferably attached to the ankle posts 52 and 54 by stitching. However, other various conventional methods such as riveting or stapling may be used.

The cushioning layer 96 is attached to the inner side of the first strap 90 to contact the wearer's foot, providing cushioning and comfort. The cushioning layer 96 is preferably stitched to the first strap 90, but may be attached by other suitable methods such as passing the strap through a sleeve on the cushion layer, snaps or a hook and loop closure such as Velcro®. In the preferred embodiment, the first and second straps 90 and 92 are formed from nylon and the cushioning layer 96 is formed from neoprene. Other suitable materials may be used, such as leather or canvas for the straps and padded cotton, rubber or chambrelle for the cushioning layer 96.

The front portion 80 of the strapping system 50 extends from the ankle region to the forefoot region of the sandal 10. The front portion 80 includes a front strap 82, a buckle strap 84 and a buckle 86. The front strap 82 and the buckle strap 84 are made out of nylon although other suitable durable materials such as leather and canvas may be used. The buckle 86 is a conventional buckle formed from conventional materials and is well known in the art.

The front trap 82 includes a first end 81 and a second end 83. The front strap 82 is attached at a first end 81 to the medial ankle post 54, preferably by stitching. Other conventional attachment methods, such as riveting or stapling, may be used to secure the front strap 82 to the medial ankle post 54. The second end 83 is attached to the flexplate 30 near the medial edge 37. The front strap 82 threads over the foot, through the apertures 46 and the channels 36 to form a crossover centered over the sole 8, as shown in FIG. 2. The buckle 86 is attached to the front strap 82, somewhat near the first end 81. The front strap 82 is described in greater detail below in relation to the wearer's foot.

The buckle strap 84 is the adjustment strap for the front strap system 80. The buckle strap 84 is attached to the lateral ankle post 52 at a first end 58 and threads through the buckle 86. The second end 87 is left free for the user to pull on, thereby moving the buckle toward 86 the lateral ankle post 52 and adjusting the front strap 82 as desired. The buckle strap 84 is formed of nylon, although leather and other suitably durable materials may be used. It should be readily apparent that the front strap system 80 may be formed in almost a near mirror image where the buckle strap 84 is attached to the medial ankle post 54 and the first end 81 of the front strap 82 is attached to the lateral ankle post 52. Further, the second end 83 of the front strap 82 would be attached near the lateral edge 39 of the flexplate 30, while keeping the X-shape of the front strap 82 centered over the wearer's forefoot.

As noted above, the second end 83 of the front strap 82 is attached to the flexplate 30 near the medial edge 37. More specifically, the second end 83 is mounted in the channel segment 74, preferably by an adhesive or two-sided tape. Other means of attachments such as stitching, riveting or pins may be used to secure the front strap 82 in the channel segment 74. The front strap 82 then passes from the channel segment 74 through the aperture 100. In relation to the wearer's foot (not shown), the front strap 82 emerges from aperture 100 approximately centered along the length of the first body metatarsus (not shown). As shown in FIG. 2, the front strap 82 forms a first portion 110 by passing from aperture 100 near the medial side 16 across the foot to aperture 102, near the lateral side 18. In relation to the wearer's foot (not shown), the front strap 82 enters aperture 102 near the fifth body of the second row of phalanges (not shown). Aperture 102 is connected to the front channel 70, allowing the front strap 82 to pass through the midsole 40 and into the front channel 70 defined by the flexplate 30. The front strap 82 then passes from the lateral side 18 to the medial side 16 through the front channel 72 to emerge from aperture 104, near the first body of the first row of phalanges (not shown). From aperture 104, the front strap 82 passes over the forefoot to aperture 106, defining a second portion 122. The first portion 110 and the second portion 122 form an X-shape crossover located substantially at the center of the wearer's foot. The second portion 122 preferably passes under the first portion 110 so as the front strap 82 is being adjusted, it does not become pinched against the foot until all adjustment is done. In relation to the wearer's foot (not shown), the front strap 82 enters aperture 106 near the fifth body metatarsus (not shown). The front strap 82 passes through aperture 106 through the middle channel 72 and out aperture 108. Aperture 108 is near the first cuneiform (not shown) and the navicular (not shown) in relation to the wearer's foot. From aperture 108 the front strap 82 passes over the instep of the foot and through the buckle 86. From the buckle 86, the front strap 82 passes back across the instep of the wearer's foot to the medial ankle post 54. It should be understood that the above description of the front strap 82 is the preferred embodiment and that variations are possible without departing from the spirit of the invention.

The sandal 10 is worn by a wearer by first releasing tension on the strap system 50 with the buckle 86. The wearer pivots the buckle 86 to release the buckle strap 84 which releases tension on the front strap 82. The wearer may also loosen or unstrap the ankle strap system 60 by loosening the first strap 90. The wearer then slips his or her foot (not shown) between the ankle posts 52 and 54 and forward under the front strapping system 80. The wearer may then tighten the ankle portion 60 of the strapping system 50 and the front portion 80 of the strapping system 50 to secure the foot against the sandal sole 8. When the front strap system 80 is tightened, the front strap 82 slides through the apertures 46 and the channels 36 pulling snuggly against the wearer's foot along its entire length from ankle region to forefoot region.

II. Manufacture and Assembly

The sandal 10 is manufactured using generally conventional machinery. The outsole 20 is manufactured by using conventional techniques and apparatuses. The outsole 20 is preferably injection or pour molded from a hard durable rubber using conventional molding apparatuses. The outsole 20 can be manufactured from other durable outsole materials. The thread pattern 24 is formed during the molding operation as an integral part of the outsole 20.

The flexplate 30 is generally molded from nylon that may be reinforced by other materials, such as fiberglass. The flexplate 30 is molded to the desired shape and upon curing is removed from the flexplate mold (not shown). The midsole 40 is then manufactured by placing the flexplate 30 in a base mold (not shown). If the flexplate 30 is desired to be bonded to the outsole 20, it is placed in the bottom of the base mold (not shown). The mold (not shown) may also incorporate locating pins (not shown). These locating pins may raise the flexplate 30 so that the midsole 40 is molded around and completely encases the flexplate 30. Alternatively, the midsole 40 may be molded without incorporating the flexplate 30, which is later cemented or otherwise bonded to the midsole 40. The mold (not shown) may include a textured surface to give the midsole 40 texture to increase friction between the foot and the midsole 40. After the midsole 40 has cured, the apertures 46 are cut using a die. The apertures 46 allow the strapping system 50 to pass through the midsole 40. If desired, the apertures 46 can be formed as an integral part of the midsole 40 molding process using appropriately located pins (not shown).

The air-cushioning device 42 is preferably manufactured using conventional techniques and apparatuses and therefore, will not be described in detail. The air-cushioning device 42 may be made out of a variety of conventional materials, selected to provide the proper amount of cushioning under load. The air-cushioning device 42 may be cemented, frictionally fitted, held in place by the strapping system 50, or otherwise secured as desired.

The strapping system 50 is preferably made using conventional nylon webbing straps that are well known in the art. The individual pieces of the strapping system 50 are cut to length and stitched together. The upper portion 64 of the medial ankle post 54 is stitched to the front strap 80 and the second strap 92. The lateral ankle post 52 is stitched to the buckle strap 84 and the first strap 90. The lateral and medial ankle posts 52 and 54 are also doubled over and stitched together to provide sufficient stiffness so that the ankle posts 52 and 54 can stand somewhat upright to allow the wearer to insert their foot without having to always adjust or hold the ankle posts 52 and 54. The ankle posts 52 and 54 are then inserted through apertures 110 and 112 and stitched together to form a single ankle strap 56. The ankle posts 52 and 54 may be stitched together, doubled over as shown in FIG. 3 or singly as shown in FIG. 7. The first end 81 of the front strap 82 is stitched to the medial ankle post 54. The second end 83 is then inserted and weaved through apertures 108, 106, 104 and 100 as described above and shown in FIG. 2 After being inserted through aperture 100, the second end 83 of the front strap 82 is attached by adhesive or double-sided tape to the flexplate 30 in the channel segment 74. The optional channel covers 34 may then be inserted over the front and middle channels 70 and 72 to prevent the front strap system 80 from binding while the sole 8 is under load. Next, the outsole 20 is attached by cement or otherwise bonded to the midsole 40 and flexplate 30.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention which an exclusive property or privilege is claimed are defined as follows:

1. A sandal comprising:

a sole having an ankle region and a forefoot region, said sole defining a plurality of channels;

a first strap including a first end and a second end and having a length defined between said first and second ends, said first strap extending from said ankle region into said forefoot region, said first strap traversing at least a portion of the sole in at least one of the ankle region and the forefoot region forward of an ankle of a user, said first strap slidably extending through said channels, said first strap crisscrossing itself above said sole in said forefoot region to define a crossover approximately centered over said sole in said forefoot region, said first strap terminating at said second end, said second end fixedly joined with said sole at a location remote from said first end; and a second strap joined with the first strap, said second strap adapted to pull the first strap across the sole along said length, whereby said first strap tightens through said ankle region and said forefoot region.

2. The sandal of claim 1 wherein said sole includes a flexplate, said channels disposed below said flexplate.

3. The sandal of claim 2 wherein said channels are defined by said flexplate.

4. The sandal of claim 3 wherein said sole includes at least one cover closing at least one of said channels.

5. A sandal comprising:

a sole having an ankle region and a forefoot region, said sole defining a plurality of channels;

a first strap having a length, said strap extending from said ankle region into said forefoot region, said strap slidably extending through said channels, said strap crisscrossing above said sole in said forefoot region to define a crossover approximately centered over said sole in said forefoot region;

a second strap joined with said first strap, said second strap adapted to pull along said length, whereby said first strap tightens through said ankle region and said forefoot region;

wherein said sole includes a flexplate defining the channels, said channels disposed below said flexplate;

wherein said sole includes at least one cover closing at least one of said channels; and wherein said flexplate includes shoulders extending along at least one of said channels, said at least one cover fitted within said channel against said shoulders.

6. The sandal of claim 5 wherein said sole defines a plurality of apertures communicating with said channels, said apertures being located near opposite ends of each of said channels.

7. The sandal of claim 6 wherein said sole includes a midsole, said flexplate at least partially entrapped within said midsole.

8. The sandal of claim 7 wherein said midsole is formed from EVA, said EVA being impregnated with an antibacterial compound.

9. The sandal of claim 8 further comprising a medial ankle post and a lateral ankle post, said strap including a first end affixed to at least one of said ankle posts.

10. The sandal of claim 9 wherein said first strap includes a second end, said second end being connected to said sole.

11. The sandal of claim 10 further comprising an adjustable ankle strap extending between said medial ankle post and said lateral ankle post.

12. The sandal of claim 8 further comprising:

a medial ankle post and a lateral ankle post, said strap including a first end affixed to said medial ankle post; and an adjustable-length buckle strap, said buckle strap interconnecting said first strap and said lateral ankle post.

13. A sandal retaining a foot having opposed lateral and medial edges and joined with an ankle, said sandal comprising:

a sole defining a plurality of channels; and a first strap including a first end and a second end, the first strap extending along a path above the sole and substantially entirely in front of the ankle from the lateral edge toward the medial edge and back toward the lateral edge, the first strap passing through said channels, said strap crisscrossing over itself above the foot to define an X-shaped crossover, said crossover being centered approximately between said lateral and medial edges, the first strap terminating at the second end, wherein the second end is fixedly secured to at least one of the plurality of channels and the sole.

14. The sandal of claim 13 wherein said sole defines a plurality of apertures located near said medial and said lateral edges, said apertures being connected to said channels.

15. A sandal retaining a foot having opposed lateral and medial edges, said sandal comprising:

a sole defining a plurality of channels;

a first strap passing through said channels, said strap crisscrossing over itself above the foot to define an X-shaped crossover, said crossover being centered approximately between said lateral and medial edges;

wherein said sole defines a plurality of apertures located near said medial and said lateral edges, said apertures being connected to said channels;

wherein said sole further comprises:

a flexplate extending through at least a portion of said sole, said flexplate being substantially rigid to provide said sole with the desired stiffness and rigidity, said flexplate defining said channels; and a midsole defining said apertures.

16. The sandal of claim 15 wherein said flexplate is bonded to said midsole.

17. The sandal of claim 16 wherein said midsole is molded about said flexplate.

18. The sandal of claim 17 further comprising a medial ankle post and a lateral ankle post, said ankle posts passing through at least two of said apertures and being interconnected through one of said channels.

19. The sandal of claim 18 further comprising an ankle strap attached to said ankle posts.

20. The sandal of claim 19 wherein said first strap includes a first end and a second end, said first end being attached to at least one of said ankle posts, said second end being secured to said sole.

21. The sandal of claim 20 further comprising a second strap having a first end and a second end, said second strap being length adjustable and extending between said first strap and the other of said ankle posts.

22. A sandal construction for a foot joined with an ankle, comprising:

a sole having an ankle portion, a forefoot portion, an upper portion, a lower portion, a lateral edge and a medial edge, said upper portion defining a plurality of apertures near said lateral and said medial edges, said lower portion defining a plurality of channels, said apertures connecting to said channels;

an ankle post located near said medial edge; and a single strap having a first end and a second end, said first end attached to said ankle post, said strap traversing the sole above the upper portion and forward of the ankle in a path from the medial edge toward the lateral edge and back toward the medial edge, said second end fixedly attached to said sole, the remainder of said first strap slidably passing through said apertures and said channels, said first strap crossing over itself to define an X pattern, said X pattern approximately centered between said lateral and medial edges.

23. The sandal of claim 22 wherein said upper portion is formed from EVA.

24. The sandal of claim 23 wherein said upper portion is impregnated with an antibacterial agent.

25. A sandal construction, comprising:

a sole having an upper portion and a lower portion, said upper portion defining a plurality of apertures near said lateral and said medial edges, said lower portion defining a plurality of channels, said apertures being connecting to said channels;

an ankle post located near said medial edge;

a first strap having a first end and a second end, said first end being attached to said ankle post, said second end being attached to said sole, said first strap slidably passing through said apertures and said channels, said first strap crossing over itself to define an X pattern, said X pattern approximately centered between said lateral and medial edges;

wherein said upper portion is formed from EVA;

wherein said upper portion is impregnated with an antibacterial agent; and wherein said lower portion is manufactured from a plate of polymeric amide, said plate being shaped to define said channels.

26. The sandal of claim 25 further comprising at least one cover, said cover enclosing at least one of said channels to define a substantially rigid passage for said strap.

27. A sandal construction comprising:

a sole having an ankle region and a forefoot region and including an outsole, a midsole disposed above said outsole, said outsole and said midsole defining a plurality of channels extending laterally across said sole;

a strapping system having an ankle strap and a front strap, said ankle strap extending across said sole substantially only in a location rearward of a heel of a foot in said ankle region to retain the heel of the foot said front strap separate from the ankle strap, extending from said ankle region to said forefoot region, said front strap slidably passing through said channels and crisscrossing itself above said midsole to define a crossover in said forefoot region, said crossover being substantially laterally centered in said forefoot region, said front strap terminating at an end, said end fixedly secured within at least one of said plurality of channels; and a buckle coupled to said front strap, in a manner enabling a user to loosen and tighten said front strap in said ankle region and said forefoot region.

28. The sandal of claim 27 further comprising a plate disposed between said outsole and said midsole, said channels being defined between said plate and said outsole.

29. A sandal construction comprising:

a sole having an ankle region and a forefoot region:

a midsole disposed above said outsole;

said outsole and said midsole defining a plurality of channels extending laterally across said sole;

a strapping system having;

an ankle strap extending across said sole in said ankle region to retain a heel of a foot;

a front strap extending from said ankle region to said forefoot region, said front strap slidably passing through said channels and crisscrossing above said midsole to define a crossover in said forefoot region, said crossover being substantially laterally centered in said forefoot region;

an adjustment means for adjusting said front strap in relation to said sole, said adjustment means loosening and tightening said strap in said ankle region and said forefoot region;

comprising a plate disposed between said outsole and said midsole, said channels being defined between said plate and said outsole;

wherein said plate defines shoulders extending along opposite sides of at least one of said channels; and further comprising a cover fitted into said channel in engagement with said shoulders.

* * * * *

UNITED STATES PATENT AND TRADEMARK OFFICE

CERTIFICATE OF CORRECTION

PATENT NO. : 6,637,130 B2
DATED : October 28, 2003
INVENTOR(S) : Grant A. Urie et al.

It is certified that error appears in the above-identified patent and that said Letters Patent is hereby corrected as shown below:

Column 11,
Line 42, after "foot" insert -- , --

Column 12,
Line 17, insert as new paragraph -- an outsole; -- before new line beginning "a midsole"

Signed and Sealed this

Second Day of March, 2004

JON W. DUDAS
*Acting Director of the United States Patent and Trademark Office*